United States Patent [19]

Faas et al.

[11] Patent Number: 5,025,533

[45] Date of Patent: Jun. 25, 1991

[54] METHOD OF BLENDING TEXTILE FIBERS

[75] Inventors: Jurg Faas, Dinhard; Eduard Nuessli, Wiesendangen; Christof Grundler, Winterthur; Paul Staheli, Wilen b. Wil; Daniel Hanselmann, Winterthur; Robert Demuth, Nuerensdorf; Rene Waeber; Peter Fritzsche, both of Winterthur, all of Switzerland

[73] Assignee: Rieter Machine Works, Ltd, Winterthur, Switzerland

[21] Appl. No.: 400,693

[22] Filed: Aug. 30, 1989

[30] Foreign Application Priority Data

Sep. 6, 1988 [CH] Switzerland ..... 03355/88

[51] Int. Cl.[5] ..... D01G 7/00; D01G 13/00

[52] U.S. Cl. ..... 19/145.5; 19/105; 19/81; 19/80 R

[58] Field of Search ..... 19/145.5, 81, 80 R, 19/105

[56] References Cited

U.S. PATENT DOCUMENTS

| | | | |
|---|---|---|---|
| 2,885,741 | 5/1959 | Leineweber | 19/145.5 |
| 2,897,548 | 8/1959 | Barnett | 19/145.5 X |
| 2,964,802 | 12/1960 | Aono | 19/105 |
| 4,000,541 | 1/1977 | Marzoli | 19/81 |
| 4,009,663 | 3/1977 | Keller | 104/1 R |
| 4,100,651 | 7/1978 | Wornal et al. | 19/145.5 |
| 4,161,052 | 7/1979 | Erben | 19/105 X |
| 4,399,590 | 8/1983 | Wildbolz | 19/145.5 |
| 4,587,691 | 5/1986 | Hosel | 19/80 R |
| 4,723,344 | 2/1988 | Leifeld | 19/105 |

FOREIGN PATENT DOCUMENTS

| | | |
|---|---|---|
| 3335763 | 4/1985 | Fed. Rep. of Germany . |
| 0481230 | 11/1969 | Switzerland . |
| 1216148 | 12/1970 | United Kingdom . |

*Primary Examiner*—Werner H. Schroeder
*Assistant Examiner*—Ismael Izaguirre
*Attorney, Agent, or Firm*—Kenyon & Kenyon

[57] ABSTRACT

Individual fiber components are blended in accordance with the properties of a required intermediate product such as a card sliver or an end product such as a yarn. The fiber bales are combined into component groups and the fiber components in the groups are accurately supplied by metering devices to a blender in which the components are uniformly mixed. The product from the blender may be cleaned and thereafter carded into a sliver. The characteristics of the sliver, such as the color, fiber, fineness and quantity, are tested and adjustments made in the blending in dependence upon any deviation from preset values for the characteristics.

35 Claims, 5 Drawing Sheets

Fig.1
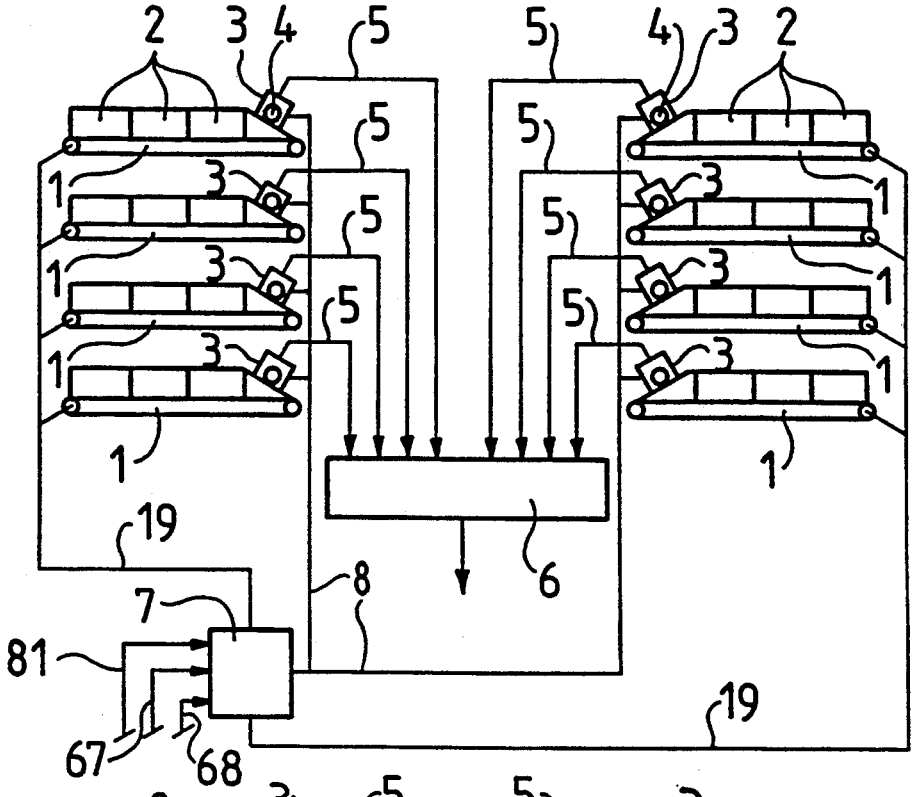
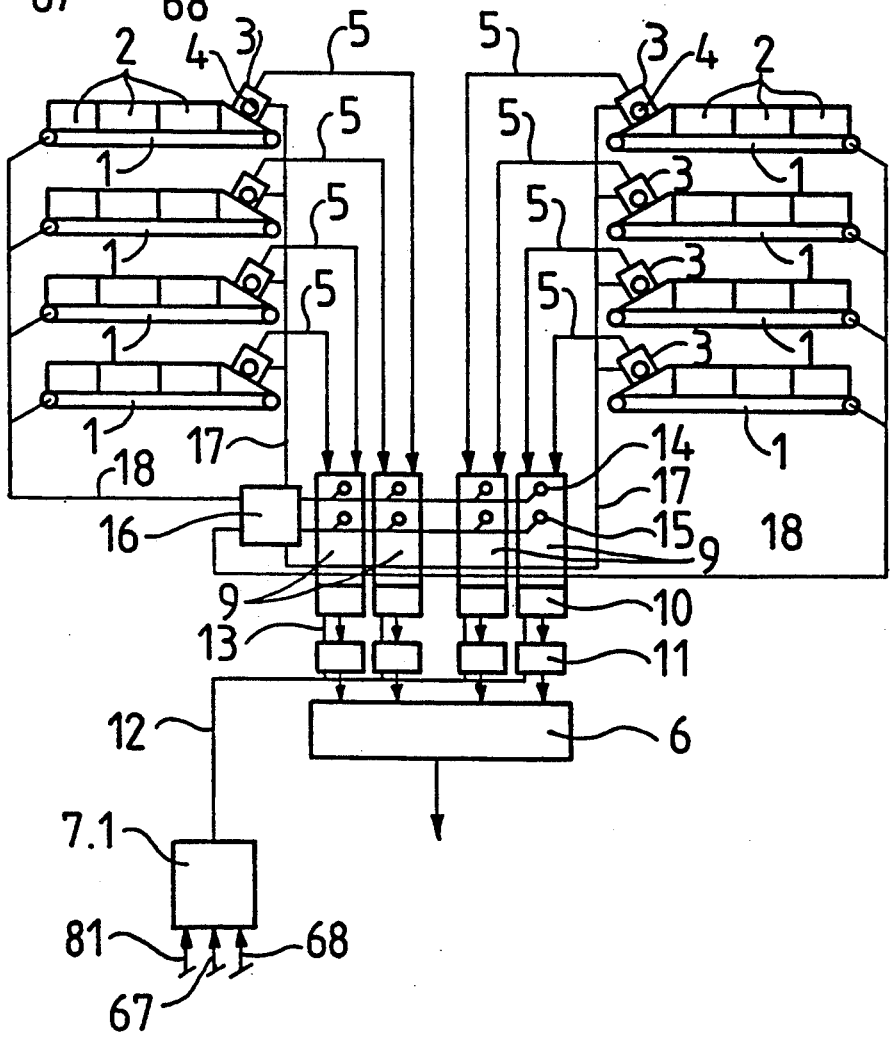
Fig.2

Fig. 3
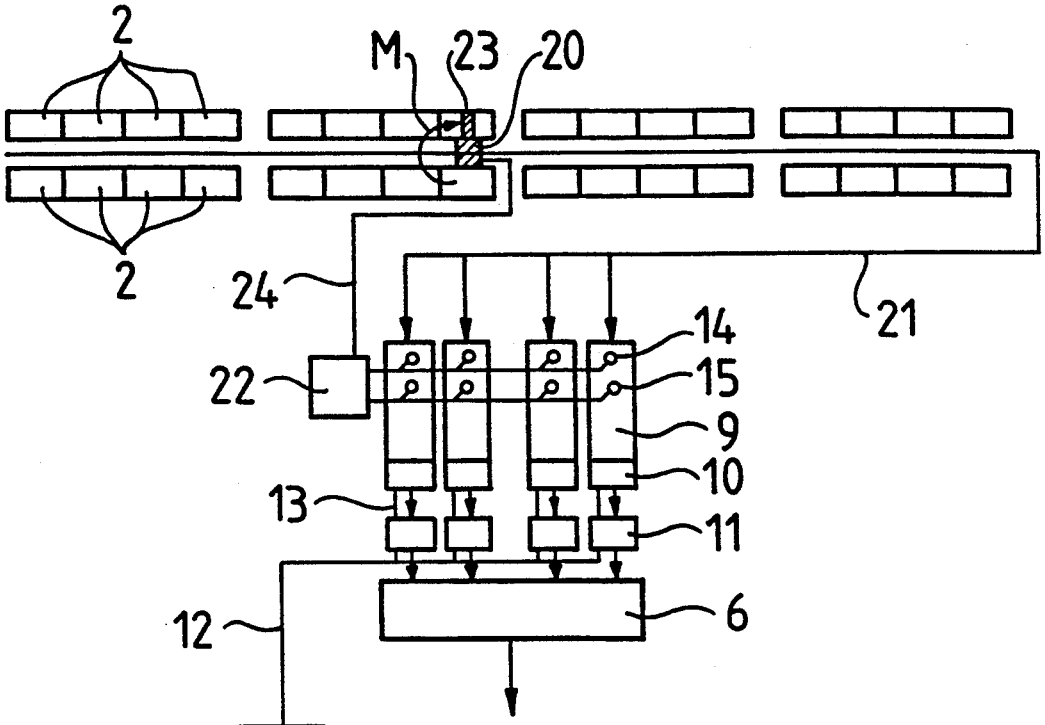
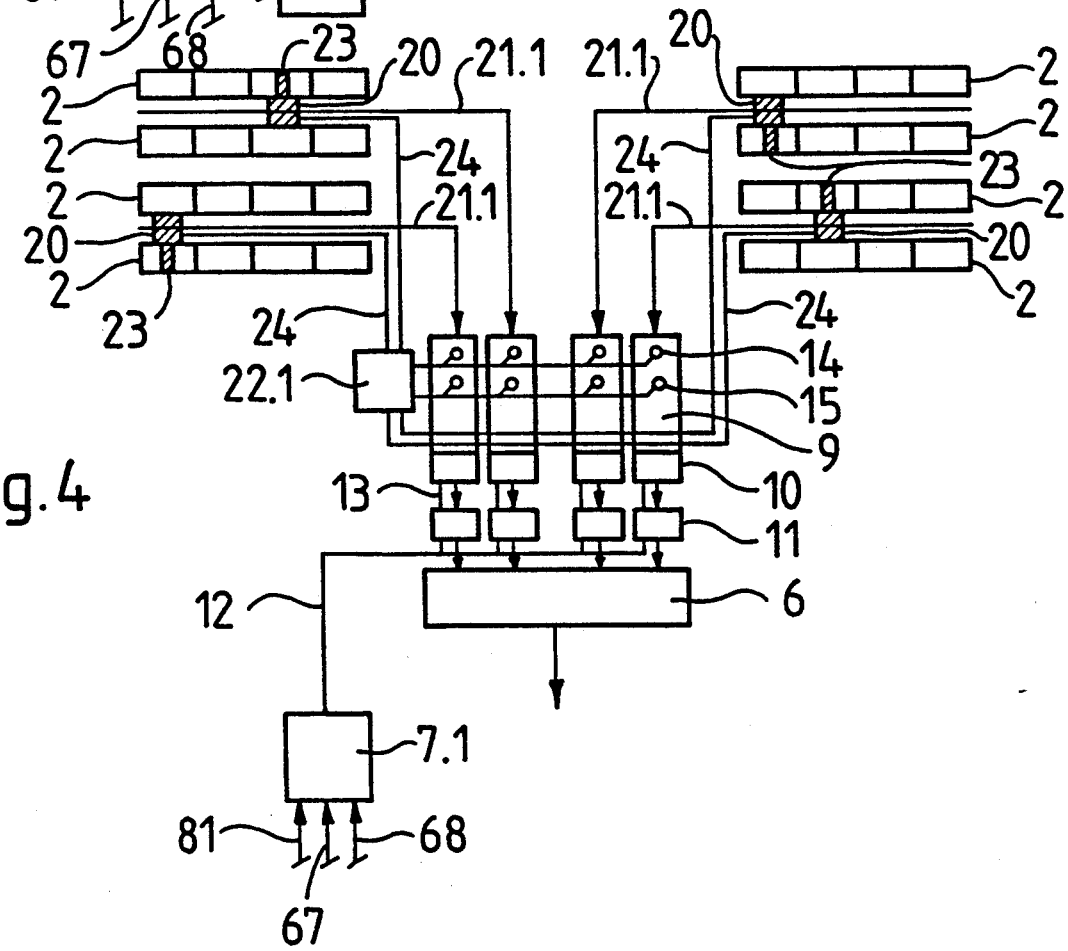
Fig. 4

METHOD OF BLENDING TEXTILE FIBERS

This invention relates to a method of blending textile fibers.

Heretofore, it has been known to process textile fibers by mixing the fibers from a plurality of bales in order to improve uniformity. In the past, several attempts have been made to mechanize the operation, such as described in U.S. Pat. Nos. 4,009,663 and 4,100,651. Generally, in conventional methods of blending, bales of varying origin are arranged in a row and are opened by an extraction device moving in reciprocation over them and extracting fiber flocks from the surface and transferring them to a conveying means. Alternatively, parts of bales are extracted manually or by machine and conveyed successively to a conveyor belt of an opening machine, in which the parts are opened to form fiber flocks and delivered to a conveying means.

The conveying means can be mechanical or pneumatic and convey the flocks to "blending boxes" into which the fibers are poured and constitute a flock mixture. The fiber flock mixture from the blending boxes is then conveyed at varying speeds to a collective conveyor in order to obtain a folding effect, the aim being to homogenize the fiber flock mixture. Homogenizing devices for this are shown and described e.g. in German patent specifications 196 821 and 31 51 063.

However, the aforementioned extraction and blending process has a disadvantage in that, since the rows of bales are stationary, the blend is unchangeable until the row has been finally extracted. Thus, the blending ratio remains the same during the whole time. The second extraction and blending process also increases the inaccuracy of the amount which has been extracted.

Accordingly, it is an object of the invention to be able to quickly alter a fiber blending process to produce an accurate homogeneous fiber blend.

It is another object of the invention to provide a relatively simple technique for controlling the quality of an end product produced from a plurality of fiber bales of different origin.

It is another object of the invention to be able to control a fiber blending process in an automated manner to produce a quality product.

Briefly, the invention provides a method of blending textile fibers which comprises the steps of extracting a fiber flock component from each of a plurality of fiber bales of varying origin and blending the fiber flock components from the fiber bales in controlled variable proportions to form a uniform blend. In accordance with the invention, a value of a characteristic of a product made from the uniform blend is measured and a deviation of the measured value from a pre-set value is obtained to immediately and automatically correct the blending of the fiber flock components in response to a deviation in order to eliminate the deviation in the product. This product may be an intermediate product such as a card sliver or an end product such as a yarn.

The properties of the fiber of each bale may also be determined in advance by sample-taking from the bales. In this way, the fibers can be exactly blended in desired proportions to obtain the required properties of an intermediate product, such as a card sliver or an end product, such as a yarn.

These and other objects and advantages of the invention will become more apparent from the following detailed description taken in conjunction with the accompanying drawings wherein:

FIG. 1 schematically illustrates an arrangement employing a method of blending textile fibers in accordance with the invention;

FIG. 2 illustrates a modified arrangement employing a method in accordance with the invention;

FIG. 3 illustrates a modified arrangement employing a single travelling extraction device for the blending of fibers in accordance with the invention;

FIG. 4 illustrates a further modified arrangement employing a plurality of travelling extraction devices in accordance with the invention;

Figure 8:
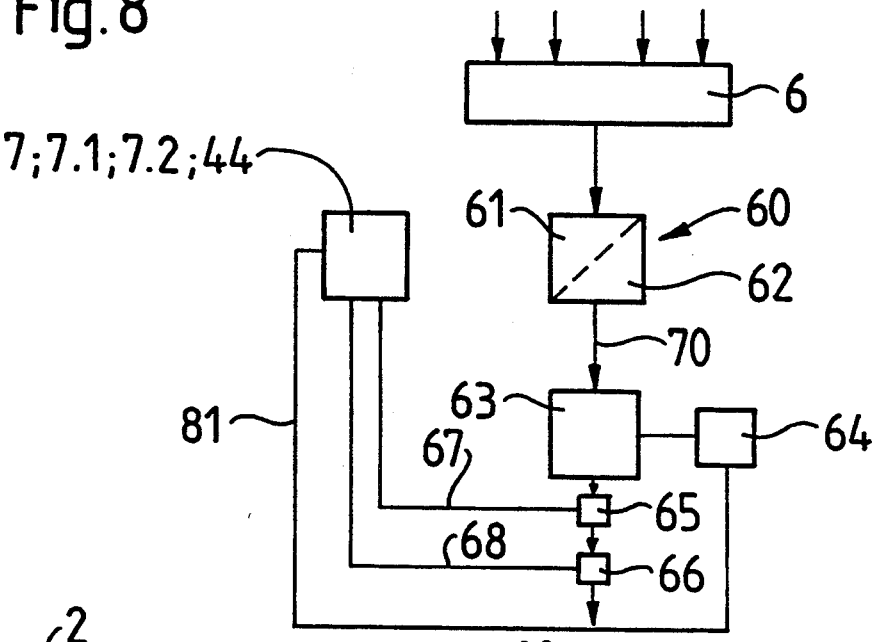
Figure 8:
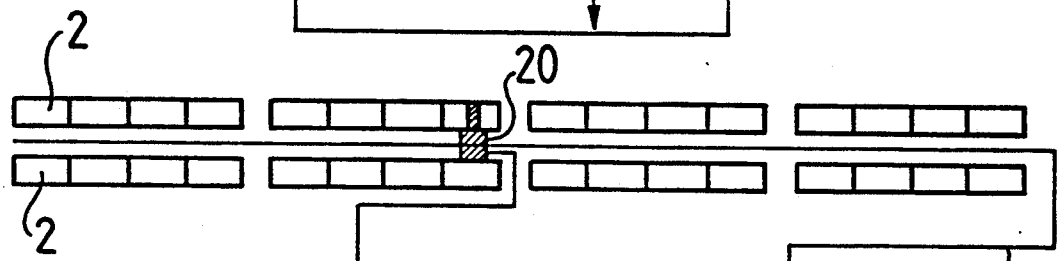
Figure 9:
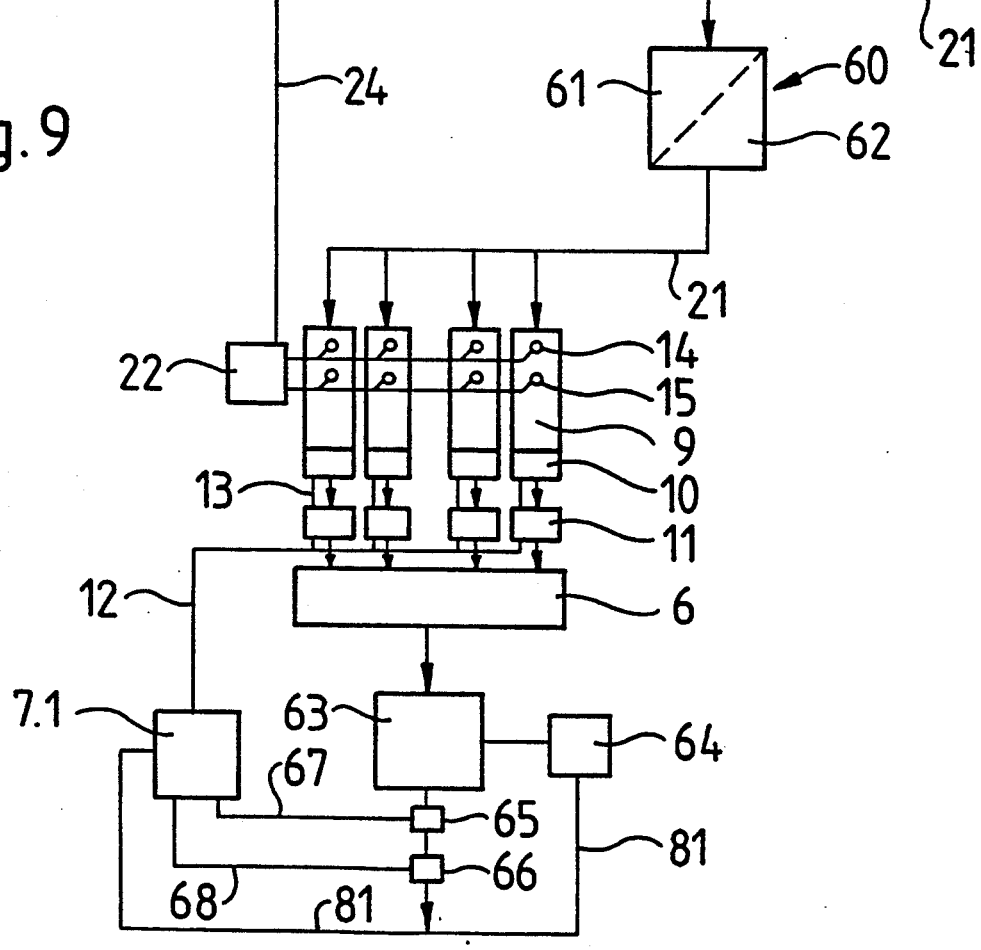
Figure 10:
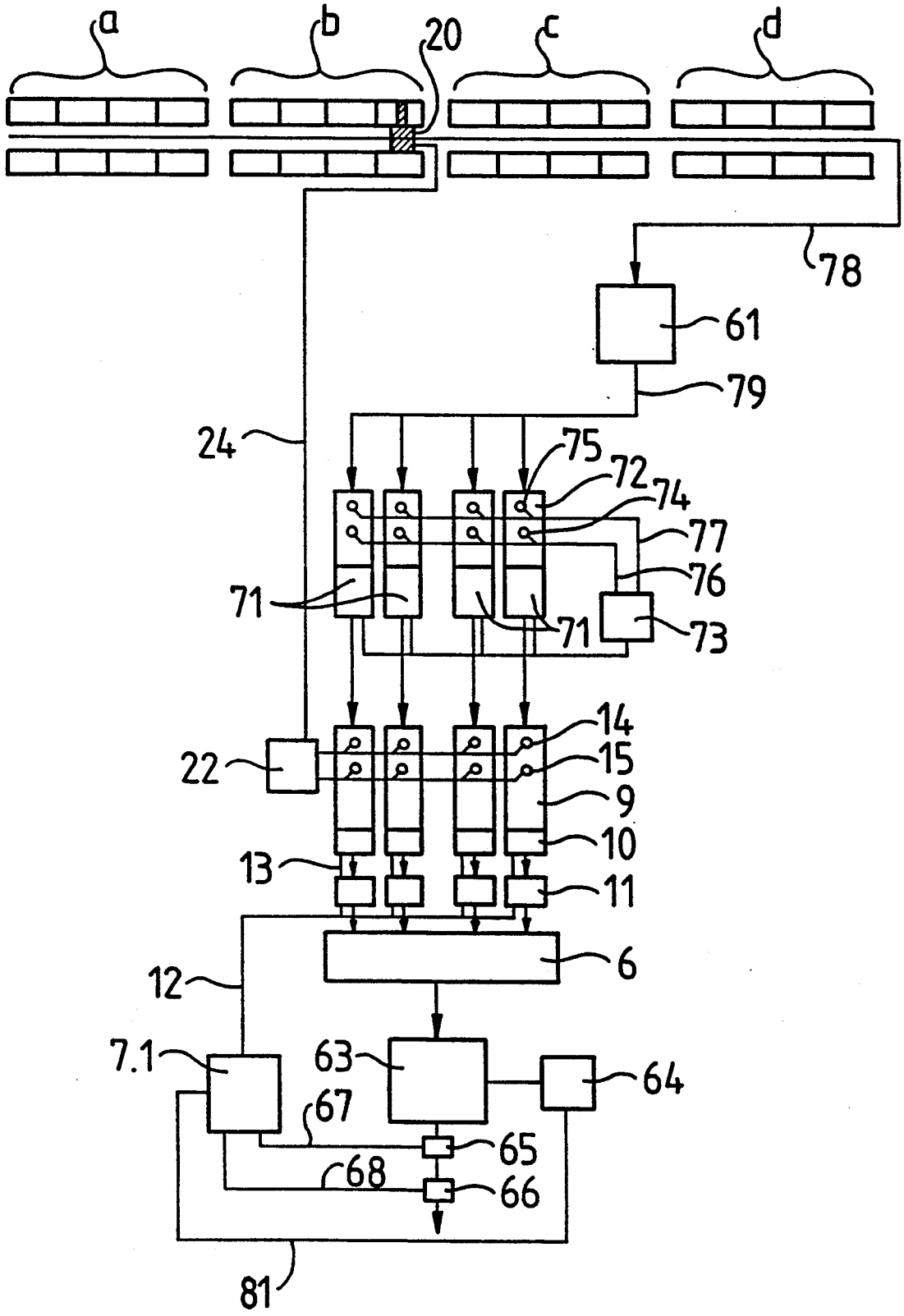

FIG. 8 schematically illustrates an arrangement for the measurement of the characteristics of a card sliver produced from a fiber blend in accordance with the invention;

FIG. 9 illustrates an overall arrangement for producing a card sliver from a plurality of fiber bales in accordance with the invention; and FIG. 10 illustrates a further modified system in accordance with the invention.

Referring to FIG. 1, a plurality of conveyor belts 1 are arranged, as indicated, so as to convey a plurality of rows of fiber bales 2 of different origin to individual fiber extraction means 3.

Each extraction means 3 moves on stationary rails disposed e.g., diagonally across the bales 2 on the conveyor belt 1. A device of this kind is known in principle from Swiss Patent No. 503 809. As a variant, use can be made of the device shown and described in Swiss Patent Application No. 00399/88-8, where the extraction means 3 is movable up and down on an extraction device (not shown) movable in reciprocation on horizontal rails along the bales 2 and is obliquely adjustable for diagonal extraction.

The extraction output can be controlled by varying the speed of the extraction means 3 along the diagonal path, or by varying the speed of advance of bales 2 by varying the speed of the individual conveyor belt 1.

Each extraction means 3 extracts fiber flocks from a foremost bale 2 in each row via a drum to form a fiber flock component which is removed in known manner through a pneumatic conveying line 5 (not described here).

The flocks are conveyed through the pneumatic line 5 to a blender 6, where they are mixed to form a uniform blend.

The quantities conveyed to the blender 6 through the individual pneumatic conveying lines 5 will hereinafter be called "fiber flock components" or simply "components".

The blenders 6 can be batch or continuous, depending on whether the aforementioned quantities are the weights of individual batches (kg) or the quantity travelling per unit time (kg/h).

For simplicity, the conveying lines 5 in FIG. 1 are shown diagrammatically as opening directly into the likewise diagrammatic blender 6, but this can be different in practice, depending on the nature of the blender. For example, air-fiber separators can be used in order to separate each fiber and air mixture, so that the fiber flocks can fall freely into the blender 6 whereas the air is discharged into an outgoing air duct. Separators of this kind are well-known in practice and are therefore not shown here separately.

The quantities of the aforementioned individual flock components delivered to the blender 6 are controlled by a control system 7 in accordance with a control program.

The control program can be a computer program comprising a component-blending program which can be adapted or altered for adaptation to alterations in the blend.

Another variant would be a digital control system for each component, in, which the output of individual components can be chosen or altered by hand.

The functions determining the extraction output of the components, e.g., the speed of advance of the respective conveyor belt 1 or the motion of the extraction means 3, are controlled by one or the other control system.

Of course, the pneumatic conveying lines need not convey the extracted product directly to the blender; mechanical conveying elements such as conveyor belts can be inserted in between. In such cases, the fiber and air separators deliver the fiber product to the mechanical conveying elements.

Each extraction means 3 is connected by a control line 8 and each conveyor belt 1 is connected by a control line 19 to the control system 7.

The three control lines 67, 68, 81 entering the control system 7 will be described hereinafter.

FIG. 2 shows a variant of FIG. 1, in which like components are given like reference numbers. In FIG. 2, the pneumatic conveying lines 5 convey the extracted fibers or fiber flocks (also called the product) not directly to the blender 6 but to component cells 9, from which the product is discharged by a discharge device 10 followed by a metering device 11 which delivers the product to the mixer 6.

The discharge device 10, depending on its nature, may alternatively also be used for metering.

The amount discharged from the individual component cells 9 is controlled by a control system 7.1 which actuates the individual metering devices 11 or, in a variant, the discharge devices 10 via control lines 12.

In the first-mentioned arrangement, the metering devices 11 can each be actuated by a control line 13 via the discharge devices 10 in order to co-ordinate the discharge with the metering. Alternatively, the discharge devices can be directly actuated by the control means 7.1.

The component cells 9 are filled by elements 1 to 5 already mentioned in connection with FIG. 1. The use of two rows of bales, each with elements 1 to 4, has been chosen by way of example only. In practice, a number of rows of bales or alternatively just a single row could be chosen per component cell 9. The decision depends on the number or blend of origins per row of bales which are to form a blend component to be supplied to a corresponding cell 9.

The filling of the component cells 9 is controlled e.g., by a full-level indicator 14 and an empty-level indicator 15 provided in each cell via a control system 16. To this end, the control system 16 for reciprocating the extraction means 3 is connected by control lines 17 to each extraction means 3 and by control lines 18 to each motor driving the conveyor belts 1.

FIG. 3 shows another embodiment in which elements already shown and described in FIG. 2 are given the same reference numbers, i.e., bales 2, component cells 9, discharge devices 10, metering devices 11, blender 6, control system 7.1 and control lines 12 and 13.

The bales 2 are in this case placed directly on the ground. As before, for the purpose of extraction, the bales 2 are divided into groups corresponding to the respective origin of the bales. Extraction is by means of a travelling extraction device 20 which moves along the groups of bales and extracts fibers or fiber flocks from the surface thereof. A device of this kind is known under the name "Unifloc" in the technical spinning sector and is sold throughout the world by Rieter Machine Ltd.

The extraction device 20 conveys the extracted fibers in known manner through a pneumatic conveying line 21 to the corresponding component cells 9.

As already described in the case of FIG. 2, the component cells 9 comprise full-level indicators 14 and empty-level indicators 15 which deliver signals to a control system 22. This control system 22 is connected by a line 24 to the extraction device 20 and controls the extraction of fiber flocks from the corresponding groups of bales in order to fill the corresponding component cells 9.

As diagrammatically indicated in FIG. 3, the extraction device 20 comprises an extraction means 23 known from Unifloc and comprises a rotating drum (not shown) which extracts fibers from the surface of the bales.

In known manner also, the extraction means 22 can be rotated through 180° as marked by arrow M so that the extraction means 22 can open the group of bales 2 on the opposite side. In this manner, either one of the facing groups of bales can be used as a reserve group or, if the extraction device 20 rotates automatically as indicated hereinbefore, the two facing rows of bales can be alternately opened in preset manner.

FIG. 4 shows a variant of FIG. 3, where components already described and shown in FIG. 3 are given the same reference numbers.

The difference between FIGS. 3 and 4 is that instead of a single extraction means 20 for the entire device, one extraction device is provided for each of two facing groups of bales.

Accordingly, the control system is denoted 22.1 instead of 22, since four individual extraction devices 20 are each separately controlled via a corresponding control line 24. Also, a pneumatic conveying line is provided for each extraction device 20; the line, which correspondingly is marked 21.1 instead of 21, opens into a respective component cell 9.

Figure 5:
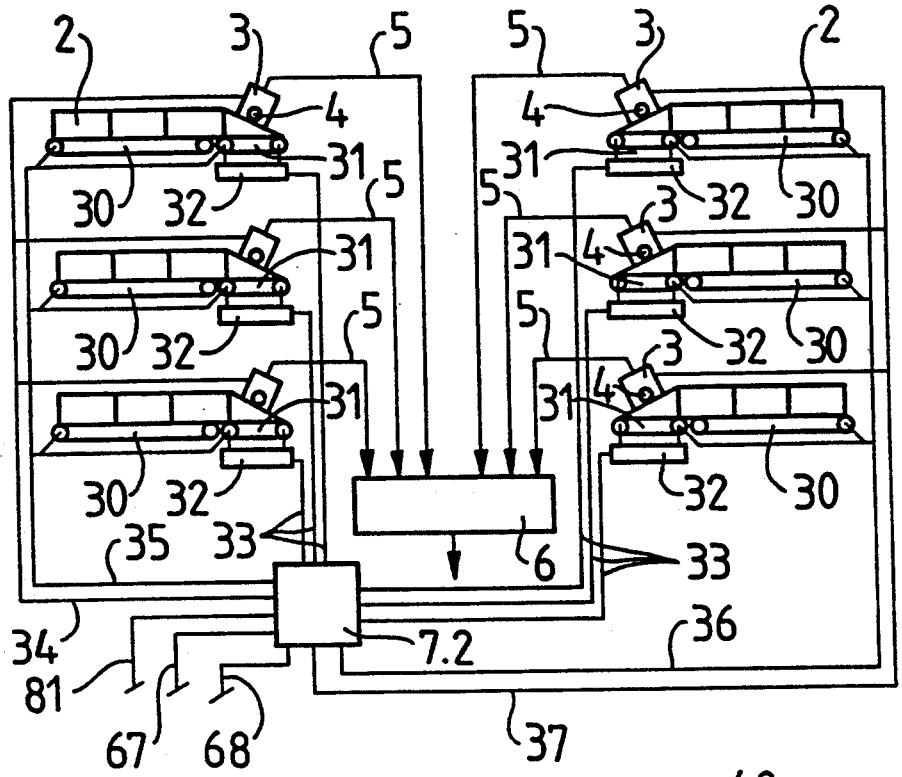
FIG. 5 illustrates a further modified arrangement employing a weighing device in accordance with the invention.

FIG. 5 shows an arrangement similar to FIG. 1, but instead of the individual conveyor belt I per group of bales in FIG. 1, each group of bales has a conveyor belt 30 used for conveying only and a conveyor belt 31 for conveying and weighing.

The conveyor belt 31 can be used for weighing by having the shafts of the guide rollers of the conveyor belt 31 mounted on known pressure cells 32 which each deliver a signal 33 corresponding to the weight, the signal being transmitted by a respective control line 33 to a signal-processing control system 7.2. The aforementioned signals are then processed in the the control system 7.2 which uses them to elaborate control signals which actuate the motors of the aforementioned conveyor belts 30, 31 via control lines 35 and also actuate the extraction means 3 via control lines 34.

Of course, other weighing machines can be used and combined with conveyor belts.

During operation, the control system 7.2 actuates the extraction means 3 and the conveyor belts 30 and 31 at preset speeds in order to extract fiber flocks from bales 2 and convey the fiber flocks through pneumatic lines 5 to the blender 6.

Each extraction means 3 for the individual groups of bales conveys a preset amount, controlled by the control system 7.2, to the blender 6. The preset extracted amount (kp/h) for each group of bales is monitored by the respective weighing conveyor belt 31 or by the pressure-cell weighing device 31 and is converted into signals and transmitted through lines 33 to the control system. If the amount (kp/h) extracted per group of bales does not coincide with the preset amount, the control system adjusts the amount for extraction until the actual amount coincides with the preset amount.

The measuring device 32 is used when the extraction means 3 is stationary for a brief moment at the turning-point in its reciprocating travel.

In this method of extraction, the extraction means 3 always travels in reciprocation along the same path, substantially diagonally across the bale to be opened. The amount (kp/h) of fiber flocks extracted from the bales is determined by means of the speed of advance of the conveyor belts 30, 31 and the extraction means 3.

The control system 7.2 can be electronic and analog-based or can be a microprocessor by means of which the individual quantities extracted per group of bales can be set and adjusted by the signals from the control lines 33 and by input signals (explained hereinafter).

Figure 6:
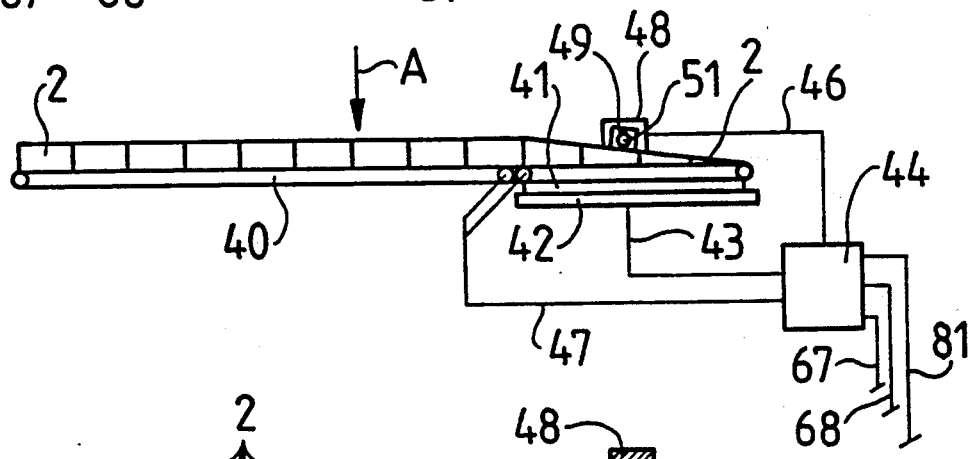
FIG. 6 illustrates a modified weighing system in accordance with the invention.
Figure 7:
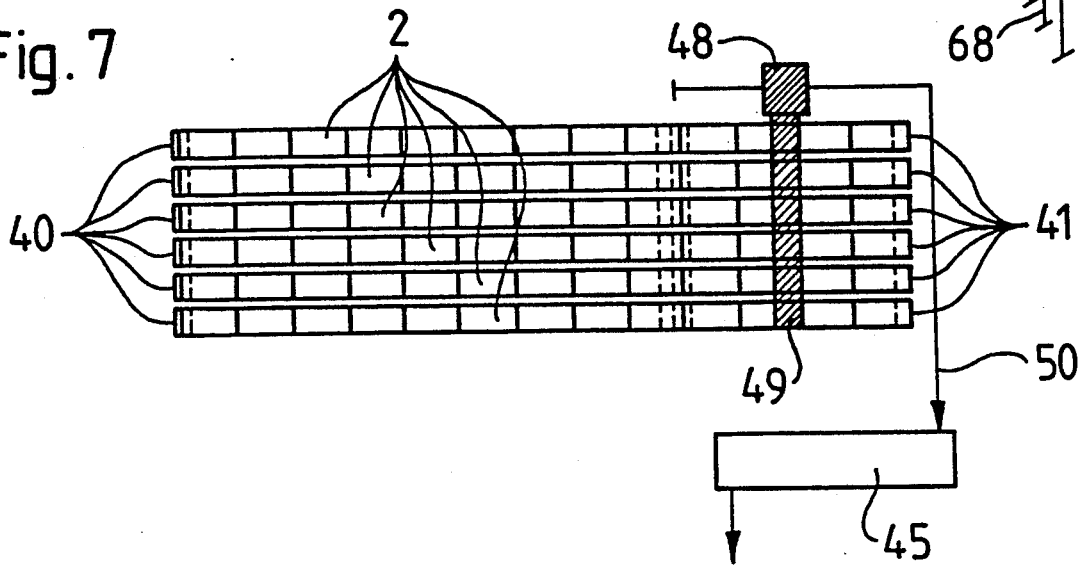
FIG. 7 illustrates a top view of the arrangement of FIG. 6.

FIGS. 6 and 7 show a weighing system similar to that of FIG. 5, FIG. 7 being a plan view of FIG. 6 in the direction of arrow A.

As can be seen in FIG. 7, a number of rows or groups of bales 2 are disposed side by side and each forms a blend component. As shown in FIG. 6, each bale 2 rests on a conveyor belt 40 and an adjacent weighing conveyor belt 41. Each weighing conveyor belt 41, like the weighing conveyor belt 31 in FIG. 5, can be mounted on pressure cells 42, from which a signal corresponding to the weight is delivered by a control line 43 to a control system 44.

The fiber bales 2 on the weighing conveyor belt 41 are opened by an extraction device 48 according to Swiss Patent Application No. 00399/88-8, already mentioned in connection with FIG. 1. The main difference is that the extraction device 49 is long and extends over the preset number of rows of bales and comprises an extraction drum 51 which extracts fiber flocks simultaneously from all the predetermined rows of bales as shown in FIG. 7.

Another difference between this method of extraction and that described in FIG. 1 is that the fiber extraction means 49 operates along an oblique track substantially corresponding to the diagonal across a preset number of adjacent fiber bales 2 in a line, e.g., four bales 2 as shown in FIGS. 6 and 7. Of course, a different number of bales could be obliquely opened in the same manner, e.g., just a single bale as shown in FIGS. 1 and 2.

Likewise, the possible length of the extraction means 49 determines the number of bales which can be lined up side by side in order to be opened simultaneously.

The fiber material extracted by means 49 is conveyed along a pneumatic line 50 which opens into a continuous blender 45. As described in the case of FIG. 1, line 50 can open into a previously-mentioned separator (not shown) which delivers the product to the blender 45.

The speed of the extracting device 48 is also controlled by the control system 44 via line 46.

Another control line 47 is provided for actuating the motors driving the guide rollers of the control belts 40 and 41.

Of course, the guide rollers of the conveyor belts 40 and 41, not separately marked, for each group of bales have a separate drive motor, i.e., each motor has a separate control line 47 to the control system 44.

During operation, the control system 44 controls the reciprocating motion of the extraction device 48 along the bales on the weighing and conveyor belt 41 nd the up and down motion of the extraction means 49 on device 48 during the aforementioned reciprocating movement, so that the bales, as shown in FIG. 6, are opened in an inclined direction substantially corresponding to the diagonal across the four bales 2.

The extraction motion is always along the same path and at a preset speed, so that the amounts extracted (kp/h) from the individual groups of fiber bales can be made different by individually adjusting the speeds of advance of the conveyor belts 40, 41. The different speeds of advance of the individual groups of bales correspond to an extraction program in which the amounts (kg/h) extracted from individual groups of bales vary in order to obtain the aforementioned blend.

The motors driving the conveyor belts 40 and 41 are advantageously axial motors incorporated in the guide roller of the conveyor belts. Axial motors can be driven at varying frequency via frequency inverters, i.e., at varying speeds, this being a feature of the control system 44.

The control system 44, as in all cases and especially mentioned in FIG. 5, can be analog or digital, for controlling the quantities of the individual components. If the individual quantities of components do not correspond to the set values they are corrected by signals from the pressure cells, which are transmitted through line 43 to the control system 44.

FIG. 8 shows an extension of the previously described method, where the product leaving the blender 6 is delivered to a "cleaning station" 60 in which known cleaning machines are used.

The cleaning station 60 can contain "coarse" cleaning machines 61 and "fine" cleaning machines 62. As before, the cleaning station is shown diagrammatically only. The same applied to a card 63 which follows the cleaning station 60 and can be a known card, e.g., card C4 sold throughout the world by Rieter Machine Ltd. The card 63 has a known control system 64 which controls the carding operations and is adapted, inter alia, to ensure the uniformity and quantity (kp/h) of card sliver.

After the card (relative to the belt conveying direction) and before the card sliver receiver (not shown), the characteristics of the sliver are measured to obtain a value thereof. For example, the card sliver is tested by a color sensor 65 and by a sensor 66 for measuring the fiber fineness. Both sensors or one or the other sensor can be used as required.

In the case shown in FIG. 8, the color sensor 65 delivers a signal corresponding to the color of the sliver via a line 67, and the fiber fineness sensor 66 delivers a signal corresponding to fiber fineness via a line 68 to the control devices 7; 7.1; 7.2; 44 mentioned in conjunction with FIGS. 1 and 7 respectively controlling the individual fiber components. Another signal corresponding to the quantity of sliver (kg/h) is input by the card control system 64 via a line 81, likewise to the control systems 7; 7.1; 7.2; 44. These three signals are compared by the aforementioned control systems with the set values received in these control systems for, respectively, the sliver color, the fiber fineness and the output, so that any deviations therefrom during operation can be eliminated by varying the component mixture and the output.

The product delivered by blender 6 is conveyed by a conveyor system to the cleaning station 60 and thence via a conveying system 70 to the card 63. These conveying systems can be mechanical or pneumatic. Conveying systems may also be disposed between fine cleaning machines and coarse cleaning machines.

Likewise, the method is not restricted to a single cleaning station 60 and a single card 63 after the blender 6. A plurality of cleaning stations 60 and a plurality of cards 63 behind the blender 6 can be supplied with the product from blender 6 or, if a single mixing station is provided after the blender 6, a plurality of cards 63 can be supplied with the product from the cleaning station 60.

If a number of cards are provided, a color sensor 65 and/or a fiber-fineness sensor 66 can optionally be provided after each card, or alternatively, if a number of cards process the same product, the two lastmentioned sensors can be provided only for a "master" card.

FIG. 9 illustrates the possibility of disposing the cleaning station 60 between the fiber extractor and the component cells 9, so that the fiber material in the component cells 9 and available for blending is already clean.

The device for conveying from the extraction device 20 to the cleaning station 60 is basically similar to the pneumatic conveying line 21, and in this case also the conveying means need not be pneumatic but can be mechanical.

Likewise, the conveying means between the cleaning station 60 and the component cells 9 can also be a pneumatic conveying line, as marked at 21, but any conveying system can be used.

Likewise, the cleaning station 60 is not restricted to a combination with the device in FIG. 3. Of course, the fiber components in all the arrangements shown in the drawings, except for FIGS. 6 and 7, can first be cleaned before reaching the blender 6. It is only a question of expense, since a separate cleaning station needs to be provided for each of the components in FIGS. 1, 2, 4 and 5.

FIG. 10 shows a variant of the arrangement in FIG. 9, in which the cleaning station is divided into a coarse cleaning device comprising the cleaning machines 61 and a fine cleaning device comprising the fine cleaning machines 71, each being preceded by a storage container 72 (for simplicity only one is shown).

The fine-cleaning machines 71 are started or stopped by a control system 73, i.e., are stopped via an empty-level indicator 74 and started via a full-level indicator 75 (only one of each is shown). The full and empty-level indicators deliver signals through lines 76 and 77 to the control system 73.

The coarse cleaning machines 61 are loaded by a fiber conveyor 78, which can be similar to the pneumatic conveying line 21 in FIG. 9 or any known fiber conveying means. The same applies to the means 79 for conveying fibers between the coarse cleaning machine 61 and the storage containers 72.

The fine cleaning machines deliver their products to a respective component-blend cell 9, as already described in connection with FIGS. 2–4 and FIG. 9.

Correspondingly, the other previously-described components are given the same reference numbers and not additionally described for FIG. 10.

During operation, the components are individually cleaned and, accordingly, the empty-level indicators 15 for the individual component cells 9 cause fibers to be extracted from the corresponding bale group a or b or c or d, in order to clean the extracted fibers in the coarse-cleaning machine and deliver them to the corresponding storage container 72, which delivers the preset component to adjacent fine-cleaning machines 71.

The product is demanded by the empty-level indicator 15 because the corresponding fine-cleaning machine does not continue to deliver the product, since the empty-level indicator 74 in the storage container 72 has likewise indicated an empty level. Accordingly, the corresponding group a to d is opened until the corresponding full-level indicator 75 indicates that the level of the extracted component is full. The corresponding fine-cleaning machine can then be restarted, until the full-level indicator 14 of the corresponding component cell 9 indicates a full level.

The device for conveying fibers between the blender 6 and the card 63 can be similar to a fiber-conveying means marked 70 and described in FIG. 8.

In this variant likewise, a blender 6 can serve a number of cards, so that the fiber-conveying means conveys the product from the blender to the corresponding number of cards.

The invention thus provides a relatively simple method of blending fiber flocks from different fiber bales into a uniform blend and maintaining the blend during processing of the fiber flocks into a product such as a card sliver.

The embodiments of the invention in which an inclusive property or privilege is claimed are defined as follows:

1. A method of blending textile fibers comprising the steps of extracting a fiber flock component from each of a plurality of fiber bales of varying origin in a predetermined variably controlled metered amount corresponding to a predetermined percentage of said fiber flock component in a predetermined blend of said components;

blending the fiber flock components from the fiber bales to form a uniform blend; and automatically correcting the amount of a fiber flock component extracted from a respective bale in response to a deviation of the blend from a preset value of a characteristic thereof to eliminate said deviation.

2. A method as set forth in claim 1 which further comprises the steps of measuring a value of a characteristic of a product made from said blend, determining a deviation of said measured value from a preset value of said characteristic, and immediately and automatically correcting the blending of said fiber flock components in response to a deviation to eliminate said deviation.

3. A method as set forth in claim 2 wherein said characteristic is selected from the group consisting of fineness of fiber, color of fiber, strength of product and fiber length.

4. A method as set forth in claim 1 wherein the percentage of each fiber component in said blend is changed to effect the correction of said blend.

5. A method as set forth in claim 1 wherein the amount of fiber flock extracted from a respective bale is variably controlled to form a fiber flock component.

6. A method of blending textile fibers comprising the steps of extracting fibers from each of a plurality of fiber bales of varying origin to form a plurality of fiber flock components;

delivering each fiber flock component to a selected cell of a plurality of cells;

discharging fiber flock from each cell at a metered amount to a blender;

blending the fiber flock in the blender into a uniform blend; and automatically correcting the amount of fiber flock discharged from a respective cell in response to a deviation of the blend from a preset value of a characteristic thereof to eliminate said deviation.

7. A method as set forth in claim 6 which further comprises the steps of analyzing the properties of the fiber extracted from each bale and allocating each bale to a respective component in dependence thereon.

8. A method as set forth in claim 6 wherein fibers extracted from at least two bales are combined to form a single fiber flock component.

9. A method as set forth in claim 6 wherein fibers are extracted in an alternating manner from at least two bales to form a single fiber flock component for delivery to a selected cell.

10. A method as set forth in claim 6 which further comprises the step of cleaning the extracted fiber flocks prior to forming said fiber flock component.

11. A method as set forth in claim 6 which further comprises the step of cleaning the fiber flock components.

12. A method as set forth in claim 6 which further comprises the steps of carding the fiber flock blend into a sliver, measuring at least one of the fiber fineness and the color of the sliver, and correcting the extraction of fibers from respective cells in response to a deviation of a measured value from a present value.

13. A method as set forth in claim 6 which further comprises the steps of determining the percentage of fiber flock of each bale in said blend;

forming said blend into a product;

measuring a value of a characteristic of the product;

comparing the value of the measured characteristic with a preset value therefor to determine a deviation thereof; and changing the percentage of fiber flock of each bale in said blend in dependence on said deviation to eliminate said deviation.

14. A method as set forth in claim 6 wherein the fiber flock is metered to the blender under gravity.

15. A method as set forth in claim 6 wherein the fiber flock is metered volumetrically to the blender.

16. A method of blending textile fibers comprising the steps of forming a plurality of rows of fiber bales of different origin;

extracting fiber flocks from a foremost fiber bale in each row to form a fiber flock component;

blending the fiber flock components into a uniform blend;

carding fiber flocks from said blend into at least one sliver;

measuring at least one characteristic of a sliver to obtain a measured value thereof;

comparing the measured value with a preset value to determine a deviation of the measured value from said preset value; and extracting a greater or lesser amount of fiber flock from a respective cell in response to a determined deviation to adjust said blend to eliminate said deviation in subsequently carded sliver.

17. A method as set forth in claim 16 wherein fiber flock is extracted from each foremost bale on an inclined angle relative to said respective row of bales.

18. A method as set forth in claim 16 which further comprises the steps of delivering a respective pair of fiber components to a selected cell of a plurality of cells for accumulation therein and discharging fiber flock from each cell in a metered amount for blending into said blend.

19. A method as set forth in claim 16 wherein metering of fiber flock is controlled in dependence on said determined deviation to eliminate said deviation in subsequently carded sliver.

20. A method as set forth in claim 16 which further comprises the steps of weighing the amount of fiber flock extracted from each bale per unit of time and adjusting the rate of extraction in response to a deviation of the weighed fiber flock from a preset weight to maintain said preset weight.

21. A method of blending textile fibers comprising the steps of forming at least two groups of fiber bales of different origin;

extracting fiber flocks from an upper surface of selected bales in each group to form a plurality of fiber components;

delivering each fiber component to a selected cell of a plurality of cells for accumulation therein;

blending the fiber flock components into a uniform blend;

carding fiber flocks from said blend into at least one sliver;

measuring at least one characteristic of a sliver to obtain a measured value thereof;

comparing the measured value with a preset value to determine a deviation of the measured value from said preset value; and extracting a greater or lesser amount of fiber flock from a respective fiber bale in response to a determined deviation to adjust said blend to eliminate said deviation in subsequently carded sliver.

22. A method as set forth in claim 21 which further comprises the step of discharging fiber flock from each cell in a metered amount for blending into said blend.

23. A method as set forth in claim 22 wherein metering of fiber flock is controlled in dependence on said determined deviation to eliminate said deviation in subsequently carded sliver.

24. A method as set forth in claim 21 which further comprises the step of cleaning the fiber flock at least at one of an upstream position and a downstream position of the cells.

25. A method of blending textile fibers comprising the steps of forming a plurality of parallel rows of fiber bales of different origin;

simultaneously extracting fiber flocks from said rows and from an inclined surface of a plurality of fiber bales in each row;

blending the extracted fiber flocks to form a uniform blend;

carding the fiber flock from said blend into at least one sliver;

measuring at least one characteristic of the sliver to obtain a measured value thereof; and controlling the rate of extraction of fiber flocks from the bales in response to a deviation of a measured value from a preset value.

26. A method of blending textile fibers comprising the steps of extracting a fiber flock component from each of a plurality of fiber bales of varying origin;

blending the fiber flock components from the fiber bales in controlled variable proportions to form a uniform blend;

measuring a value of a characteristic of a product made from said blend, said characteristic being selected from the group consisting of fineness of fiber, color of fiber, strength of product and fiber length;

determining a deviation of said measured value from a preset value of said characteristic; and immediately and automatically correcting the blending of said fiber flock components in response to a deviation to eliminate said deviation.

27. A method of blending textile fibers comprising the steps of extracting fibers from each of a plurality of fiber bales of varying origin to form a plurality of fiber flock components;

delivering each fiber flock component to a selected cell of a plurality of cells;

discharging fiber flock from each cell at a metered amount to a blender;

blending the fiber flock in the blender to form a uniform blend;

carding the fiber flock blend into a sliver;

measuring a value of at least one of the fiber fineness and the color of the silver; and correcting the extraction of fibers from respective cells in response to a deviation of a measured value from a present value.

28. A method of blending textile fibers comprising the steps of forming a plurality of rows of fiber bales of different origin;

extracting fiber flocks from a foremost fiber bale in each row to form a fiber flock component;

blending the fiber flock components into a uniform blend;

carding fiber flocks form said blend into at least one sliver;

measuring at least one characteristic of a sliver to obtain a measured value thereof, said characteristic being one of sliver color, sliver quality and fiber fineness;

comparing the measured value with a preset value to determine a deviation of the measured value from said preset value; and extracting a greater or less amount of fiber flock from a respective fiber bale in response to a determined deviation in subsequently carded sliver.

29. A method of blending textile fibers comprising the steps of forming at least two groups of fiber bales of different origin;

extracting fiber flocks from an upper surface of selected bales in each group to form a plurality of fiber components;

delivering each fiber component to a selected cell of a plurality of cells for accumulation therein;

blending the fiber flock components into a uniform blend;

carding fiber flocks from said blend into at least one sliver;

measuring at least one characteristic of a sliver selected from the group consisting of sliver color sliver quantity and fiber fineness to obtain a measured value thereof;

comparing the measured value with a preset value to determine a deviation of the measured value from said preset value; and extracting a greater or less amount of fiber flock from a respective cell in response to a determined deviation to adjust said blend to eliminate said deviation in subsequently carded sliver.

30. A method of blending textile fibers comprising the steps of forming a plurality of parallel rows of fiber bales of different origin;

simultaneously extracting fiber flocks from said rows and from an inclined surface of a plurality of fiber bales in each row;

blending the extracted fiber flocks to form a uniform blend;

carding the fiber flock from said blend into at least one sliver;

measuring at least one characteristic of the sliver to obtain a measured value thereof, said characteristic being one of sliver color, sliver quantity and fiber fineness; and controlling the rate of extraction of fiber flocks from the bales in response to a deviation of a measured value from a preset value.

31. A method of blending textile fibers comprising the steps of providing a plurality of fiber bales of different origin with each said bale having a predetermined fiber characteristic;

extracting a fiber flock component from each said bale in a predetermined variably controlled meter amount corresponding to a predetermined percentage of said fiber flock component in a predetermined blend of said fiber flock components;

automatically optimizing the percentage of each fiber flock component extracted to obtain a predetermined characteristic in said blend in dependence on said characteristics of said bales; and blending the extracted fiber flock components to form a homogenous blend.

32. A method of blending textile fibers comprising the steps of providing a plurality of fiber bales of different origin with each said bale having a predetermined fiber characteristic;

extracting a fiber flock component from each said bale;

blending the extracted fiber flock components together into a uniform blend;

measuring a value of a characteristic of the blend, said characteristic being dependent on the combined characteristics of the fiber of the fiber bales; and automatically correcting the amount of at least one fiber flock component thereafter blended into the blend in response to a deviation of said measured value from a preset value to eliminate said deviation.

33. A method as set forth in claim 32 wherein the amount of fiber flock extracted from a fiber bale is corrected to eliminate said deviation.

34. A method as set forth in claim 32 wherein the extracted fiber flocks of each bale are delivered to a respective cell of a plurality of cells for accumulation therein prior to blending thereof, and wherein the amount of fiber flock extracted from a respective cell is corrected to eliminate said deviation.

35. A method as set forth in claim 32 wherein said characteristic is selected from the group consisting of fineness of fiber, color of fiber, strength of product and length of fiber.

* * * * *

UNITED STATES PATENT AND TRADEMARK OFFICE

CERTIFICATE OF CORRECTION

PATENT NO. : 5,025,533

DATED : June 25, 1991

INVENTOR(S) : JURG FAAS, et al

It is certified that error appears in the above-identified patent and that said Letters Patent is hereby corrected as shown below:

Column 3, line 15 change "in," to-in-
Column 4, line 56 change :belt I" to - belt 1-
Column 10, line 11 change "cell" to -fiber bale-
Column 10, line 53 change "fiber bale" to -cell-

Signed and Sealed this

Nineteenth Day of January, 1993

*Attest:*

DOUGLAS B. COMER

*Attesting Officer*

*Acting Commissioner of Patents and Trademarks*